US005232095A

United States Patent [19]

Childers et al.

[11] Patent Number: 5,232,095

[45] Date of Patent: Aug. 3, 1993

[54] SHIPPING APPARATUS WITH DIAGONALLY ROTATABLY MOUNTED CONTENTS

[75] Inventors: Robert W. Childers, Garner; Thaddeus J. Mielnik, Apex, both of N.C.

[73] Assignee: American Sterilizer Company, Erie, Pa.

[21] Appl. No.: 686,097

[22] Filed: Apr. 16, 1991

[51] Int. Cl.[5] ..... B65D 81/02

[52] U.S. Cl. ..... 206/583; 206/493; 217/55

[58] Field of Search ..... 206/583, 586, 521, 493, 206/433, 427, 305, 320; 248/184; 217/55

[56] References Cited

U.S. PATENT DOCUMENTS

| | | | |
|---|---|---|---|
| 177,588 | 5/1876 | Tarbox | 206/493 |
| 791,569 | 6/1904 | McKinney . | |
| 1,083,861 | 1/1914 | Schirl . | |
| 1,229,688 | 6/1917 | Wallace | 206/583 X |
| 2,031,851 | 2/1936 | Plunkett | 206/493 X |
| 2,234,089 | 3/1941 | Sanders | 206/493 X |
| 2,460,159 | 1/1949 | White . | |
| 2,596,244 | 5/1952 | Jacket | 206/583 X |
| 2,662,538 | 12/1953 | Cervino et al. . | |
| 2,765,866 | 9/1956 | Carroll, Jr. et al. . | |
| 2,800,975 | 7/1957 | Carroll, Jr. et al. . | |
| 3,180,345 | 4/1965 | Klank, Jr. . | |
| 3,482,895 | 12/1969 | Becklin | 206/305 X |
| 3,842,981 | 9/1974 | Lambert . | |
| 4,082,214 | 4/1978 | Baker . | |
| 4,313,701 | 2/1982 | Brust . | |
| 4,434,961 | 3/1984 | Hoye . | |

FOREIGN PATENT DOCUMENTS

| | | | |
|---|---|---|---|
| 138495 | 12/1901 | Fed. Rep. of Germany | 217/55 |
| 25-01913 | 11/1975 | Fed. Rep. of Germany | 206/583 |
| 61121848 | 11/1984 | Japan . | |
| 158571 | 4/1957 | Sweden | 206/320 |

*Primary Examiner*—Bryon P. Gehman

*Attorney, Agent, or Firm*—Jones, Day, Reavis & Pogue

[57] ABSTRACT

An apparatus for shipping goods which must be maintained in a predetermined orientation is provided. A closable outer container has a shaft passing through it along an axis. A weighted closable inner container is rotatably mounted about this axis so that it may freely rotate within the outer container while always assuming a predetermined orientation.

14 Claims, 10 Drawing Sheets

SHIPPING APPARATUS WITH DIAGONALLY ROTATABLY MOUNTED CONTENTS

BACKGROUND OF THE INVENTION

1. Field of the Invention

The present invention relates to a shipping apparatus, particularly to an apparatus designed to maintain goods in a predetermined orientation during shipment.

2. Description of the Prior Art

A large volume of goods are being shipped throughout the United States and the world. Many of these goods must be maintained in a particular position during shipment, often for long periods of time. It is efficient and cost effective to employ commercial shipping companies to deliver goods from one location to another. However, these companies cannot guarantee that the shipping container will remain in the specified position during shipment. It is therefore necessary to find some means for maintaining the goods themselves in the desired position despite the orientation of the outside shipping container. The desired orientation for the goods will obviously depend upon the type of goods being shipped. It is adequate for many goods to be shipped in orientations that may vary as long as the orientation does not exceed a certain tolerance from the vertical.

Means for retaining containers in the upright position are known in the art. McKinney, U.S. Pat. No. 791,569 discloses a lamp holder designed to prevent spillage of oil wherein a supporting frame has a primary ring and a freely rotating gimbal. The lamp is held in place by two arms and is pivotally suspended at right angles to the gimbal. Schirl, U.S. Pat. No. 1,083,861 discloses an ink well comprising a stationary supporting body with a weighted container suspended therein. The container remains upright no matter what the position of the supporting body.

In the Schirl and McKinney references, rotation of the suspended container is about two orthogonal axes. The suspended container is not freely rotatable about every axis of the supporting body. Neither apparatus would be suitable for holding bottles of liquid in a shipping container.

It is an object of the present invention to provide an apparatus for the shipment of goods which are required to remain in certain range of positions. It is a further objective of this invention to provide a simple, inexpensive, compact yet durable apparatus for this purpose.

SUMMARY OF THE INVENTION

The present invention provides a shipping apparatus which includes a closable outer container having an axis extending therethrough. A closable inner container is disposed in and spaced from the outer container and is mounted for rotation about the axis such that the inner container is freely rotatable within the outer container. The invention further provides a means for mounting the inner container about the axis. The inner container includes means to cause it to assume a predetermined orientation, regardless of the orientation of the outer container.

In the preferred embodiment of the present invention, the outer container has the shape of a six-faced cube. The inner container is mounted along a substantially diagonal axis and will assume an orientation which is at about a 45° angle from the vertical whenever the outer container is resting upon one of its six faces.

In another embodiment of the present invention, the outer container has the shape of a six-faced, non-cubic box. The inner container is mounted along a substantially diagonal axis and will assume an orientation which is slightly less (or slightly more) than a 45° angle from the vertical whenever the outer container is resting upon one of its six faces.

The outer container may be provided in a variety of shapes and configurations. In other embodiments of the present invention, the outer container may assume various shapes ranging from, for example, a six-faced cubic box to an eight or ten faced box. In all of these embodiments, however, the inner container is mounted within the outer container so that it may freely assume the desired angular orientation.

In all of these embodiments, the vented bottle(s) packaged in the inner container, have sufficient air space near their top, or neck area, to remain vented when oriented at an angle which is at about 45° or less from the vertical. The shipping apparatus of the present invention may be used to ship vented bottles of various chemical solutions. It is important that such bottles be maintained in the desired orientation to prevent the vents from being submerged, which could result in spillage of the contents.

The means for mounting the inner container about the axis of the outer container may include a shaft. In one embodiment of this invention, the shaft is a continuous member having both a first end and a second end. When the outer container is constructed such that it has a first surface and a second surface generally opposing the first surface, the first end of the shaft is preferably connected to the first surface of the outer container and the second end of the shaft is preferably connected to the second surface of the outer container.

In an alternative embodiment, the shaft has two portions, each portion having a first end and a second end. The first end of one portion is connected to the first surface of the outer container. The first end of the other portion is connected to the second and generally opposing surface of the outer container. The second end of each portion of the shaft is rotatably connected to the inner container.

The advantages and benefits of the present invention will become apparent from the description of the preferred embodiments hereinbelow.

BRIEF DESCRIPTION OF THE DRAWINGS

In order that the present invention may be clearly understood and readily practiced, preferred embodiments will now be described, by way of example only, with reference to the accompanying figures wherein.

DETAILED DESCRIPTION OF THE PREFERRED EMBODIMENTS

Figure 1:
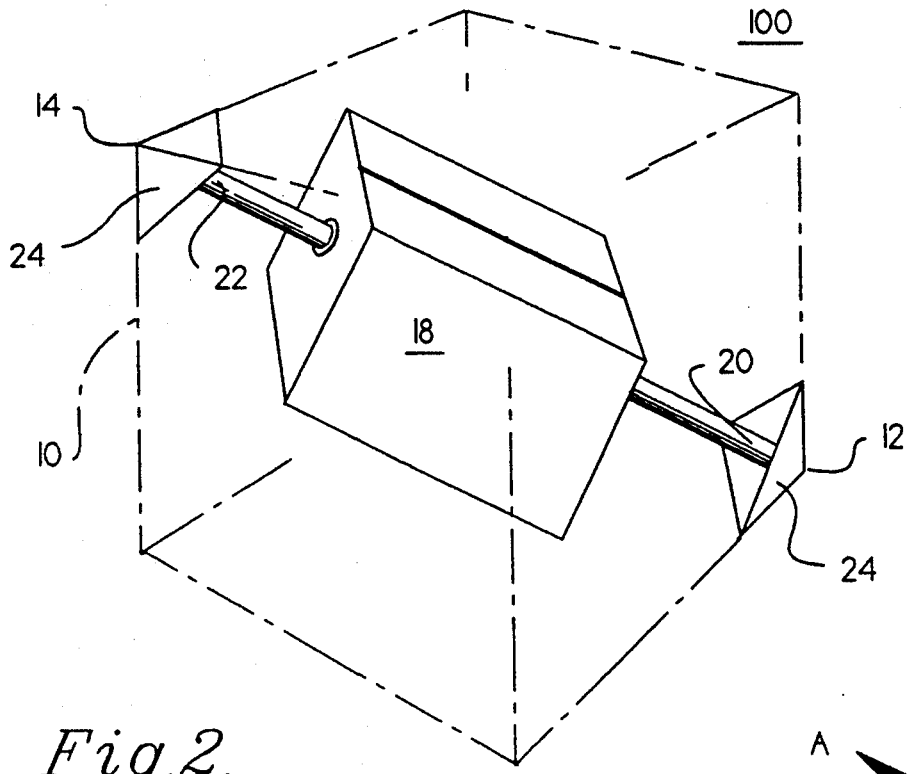
FIG. 1 is a perspective view of the shipping apparatus of the present invention.

Referring now to the drawings for purposes of illustrating the preferred embodiments of the present invention only and not for purposes for limiting the same, the figures show a shipping apparatus generally designated as 100, wherein like reference numerals are employed among the various figures to designate like elements.

FIGS. 1–4 and 9 show a preferred embodiment of the shipping apparatus provided by the present invention. The apparatus 100 generally includes a closable outer container 10 in the shape of a cube, an inner container 18 and a shaft 16. It will be appreciated that the outer and inner containers may be constructed out of a variety of materials such as cardboard or aluminum and may be provided in a variety of shapes without departing from the scope of the claimed invention.

Closable outer container 10 has a first corner 12 and a second corner 14 which generally opposes corner 12. Shaft 16 provides a means for mounting inner container 18 about an axis of outer container 10. Shaft 16 is a continuous member and has a first end 20 and a second end 22. The first end 20 of shaft 16 is connected to the first corner 12 of outer container 10. The second end 22 of shaft 16 is connected to the second corner 14 of outer container 10. The shaft 16 will thus be disposed along a substantially diagonal axis of outer container 10.

A variety of means may be used to mount shaft 16 within outer container 10. FIGS. 5–8 show a preferred means 24 for supporting shaft 16 within the outer container 10. The means, or shaft support 24 connects the shaft 16 to the opposing corners 12 and 14 of outer container 10. Shaft support 24 is comprised of three triangular planes 26, 28, and 30 of identical size and shape intersecting at a common point 32 to form a pyramid-like shape. Point 32 is the apex of each of the three triangular planes. A hollow cylindrical rod 34 for receiving the end of the shaft is permanently fixed to shaft support 24 at point 32 on the interior of the pyramid. Rod 34 is dimensioned to be of a diameter which is slightly larger than the diameter of shaft 16 so that shaft 16 may be easily inserted into and removed from rod 34. Rod 34 should be long enough, however, to secure shaft 16 in position within outer container 10 while in use.

The closable inner container 18 is mounted for rotation about the shaft 16. Inner container 18 is proportioned and positioned on shaft 16 so that it is freely rotatable about shaft 16 within outer container 10. Inner container 18 is provided with two apertures, 36 and 38 substantially opposite one another so that shaft 16 may pass directly therethrough. Washers 40 are provided at each aperture to prevent inner container 18 from sliding along shaft 16 and further to prevent shaft 16 from impinging or wearing away the material of inner container 18.

Figure 4:
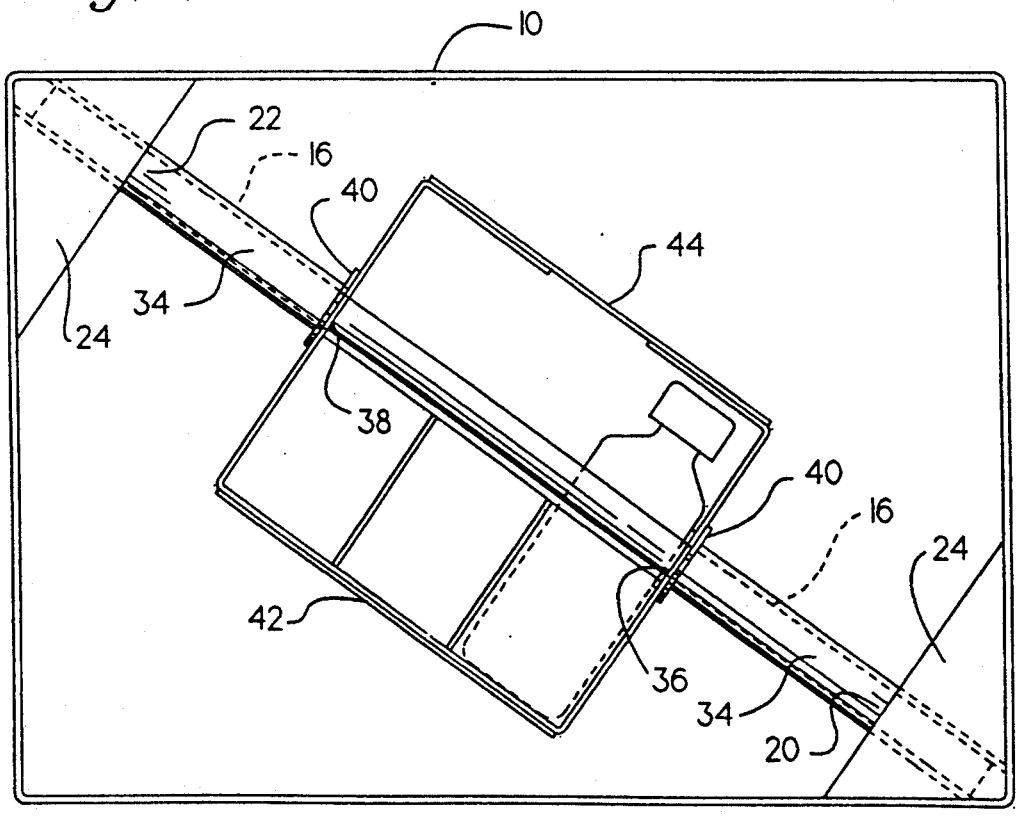
FIG. 4 is a sectional view taken along the line A—A of FIG. 2.
Figure 7:
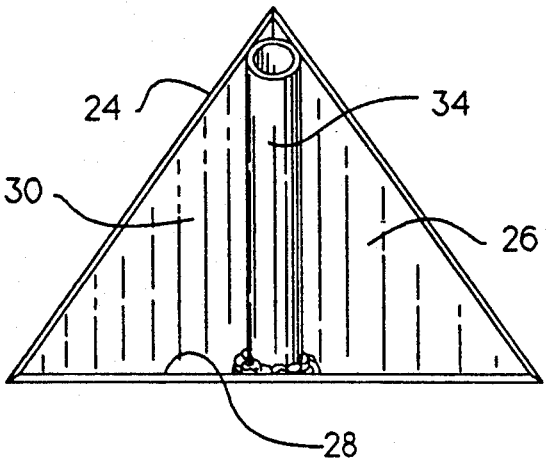
FIG. 7 is a front elevation view of the shaft support of FIG. 5.
Figure 5:
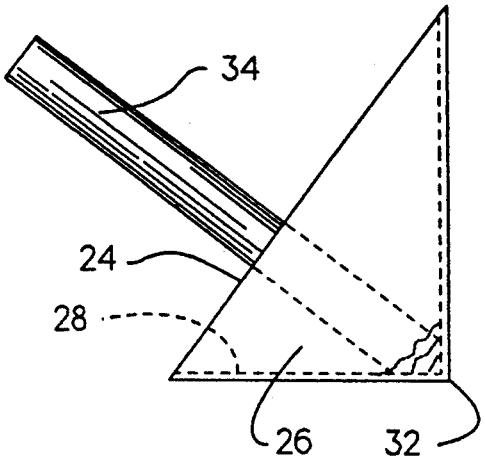
FIG. 5 is a side view of a shaft support for a shipping apparatus.
Figure 6:
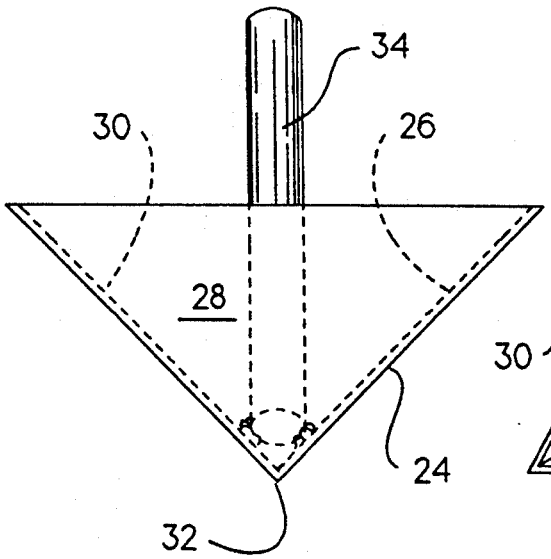
FIG. 6 is a rear view of the shaft support of FIG. 5.
Figure 8:
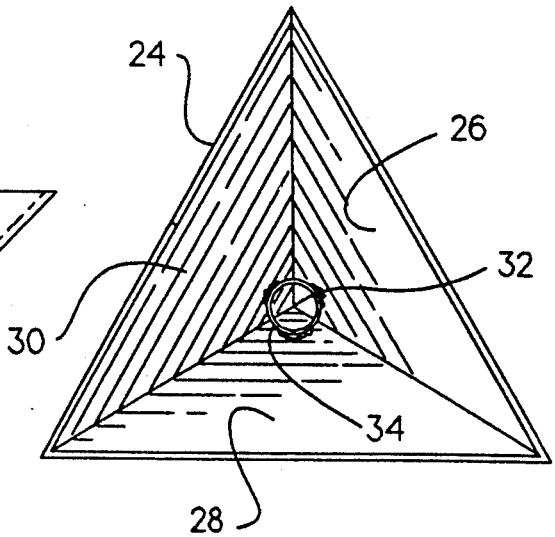
FIG. 8 is a top plan view of the shaft support of FIG. 5.
Figure 9:
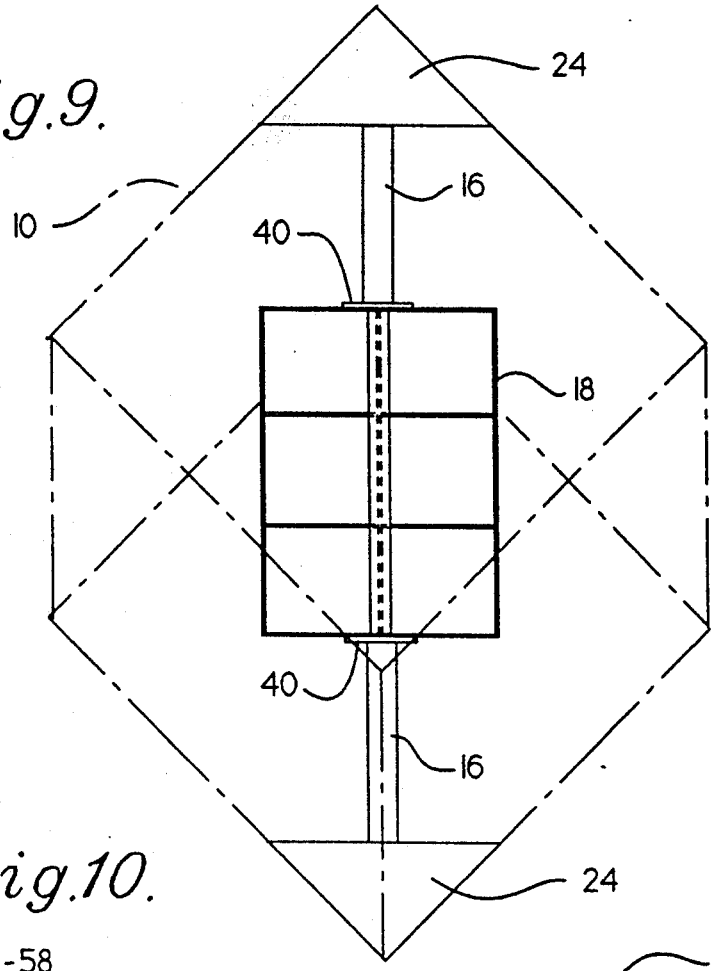
FIG. 9 is a top plan view of the inner container of the shipping apparatus of FIG. 1.

In preparation for shipment, the goods are placed in inner container 18. Inner container 18 may be adapted to receive any type of goods. As shown in FIG. 4, the interior of inner container 18 may be divided or compartmentalized using well known means. Shaft 16 is passed through apertures 36 and 38 such that it completely passes through inner container 18. Washers 40 are placed in fixed positions on shaft 16 so that each washer is flush against the surface of inner container 18 encompassing apertures 36 and 38. A first shaft support 24 is placed on shaft 16 at first end 20 and a second shaft support 24 is placed on shaft 16 at second end 22 by sliding each end of shaft 16 into the rod 34 of each of the supports 24. First shaft support 24 is placed in the corner 12 of outer container 10. Second shaft support 24 is placed in the corner 14 of outer container 10.

Inner container 18 has a base end 42 and a cover end 44. Cover end 44 contains any suitable closure means, such as flaps. Base end 42 may be weighted using conventional means for weighting a container to provide a means for causing the inner container 18 to assume a predetermined orientation regardless of the orientation of the outer container 10. By weighting base end 42, the force of gravity will cause inner container 18 to remain in an orientation such that base end 42 is always maintained in a downward position and cover end 44 will always be in an upward position.

Figure 2:
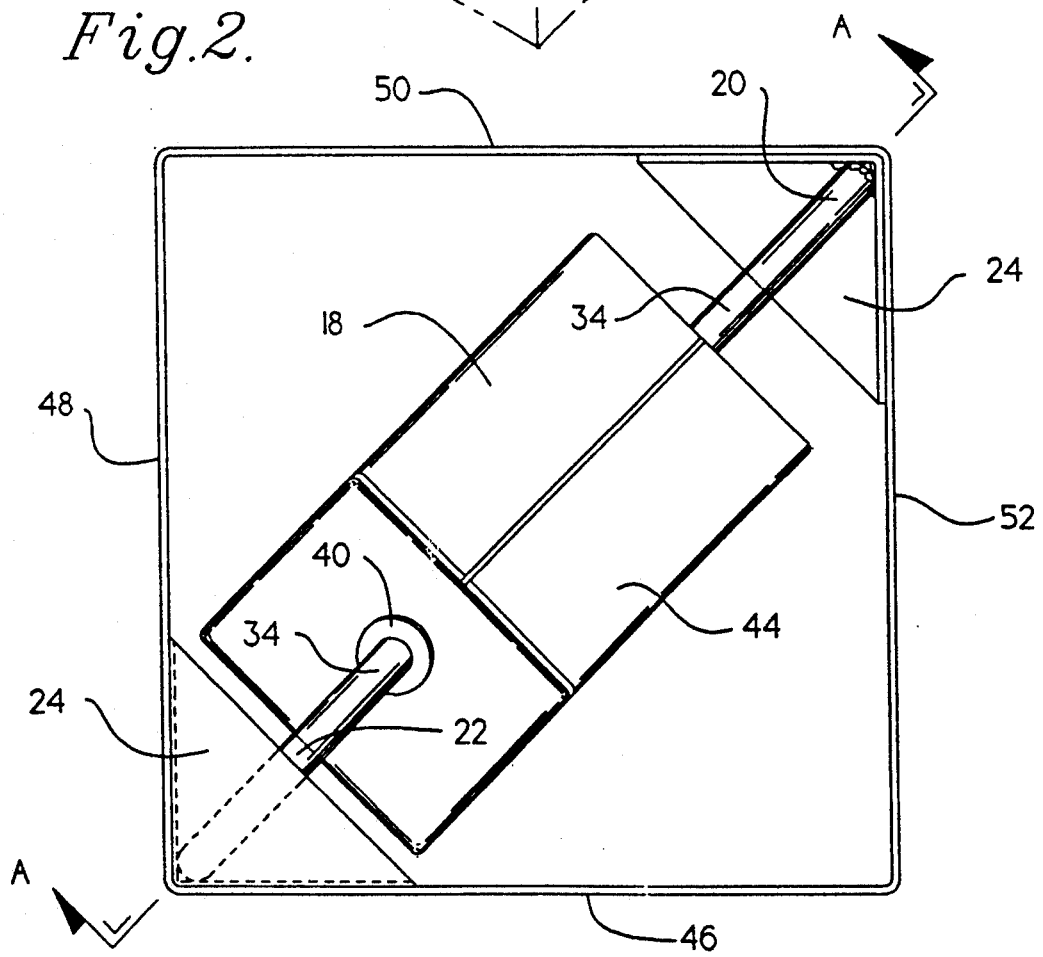
FIG. 2 is a top view of a shipping apparatus.
Figure 3:
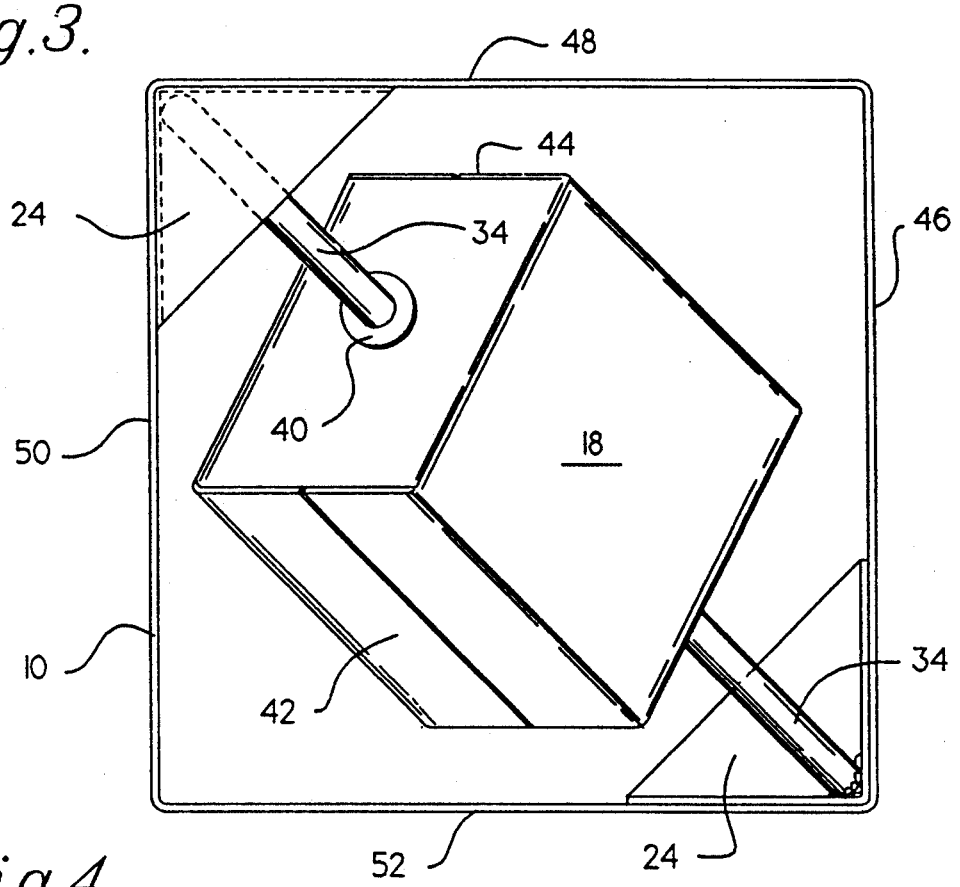
FIG. 3 is a side view of a shipping apparatus.

Referring now to FIG. 2 and FIG. 3, four sides of the six sides of outer container 10 are labeled 46, 48, 50 and 52. During shipment, outer container 10 could end up resting upon any one of its six sides. Since shaft 16 is fixed within outer container 10 during shipment, shaft 16 will move as outer container 10 moves. Since inner container 18 is weighted, it will rotate freely about shaft 16 while shaft 16 is moved into different positions thereby maintaining its predetermined orientation as outer container 10 and shaft 16 are moved.

In FIG. 2, outer container 10 is resting on side 46. Inner container 18 is in the desired predetermined orientation wherein base end 42 is downward and cover end 44 is upward. In FIG. 3, outer container 10 has been rotated and is resting on side 52. Despite this rotation of outer container 10 and shaft 16, inner container 18 retains its desired orientation.

FIG. 4 shows the desired orientation for accommodating vented bottles of chemical solutions. When the outer container 10 is cube shaped and shaft 16 is substantially diagonal within the cube, the weighted inner container 18 will assume an orientation within inner container 10 which is at a 45° angle from the vertical axis of outer container 10.

Figure 10:
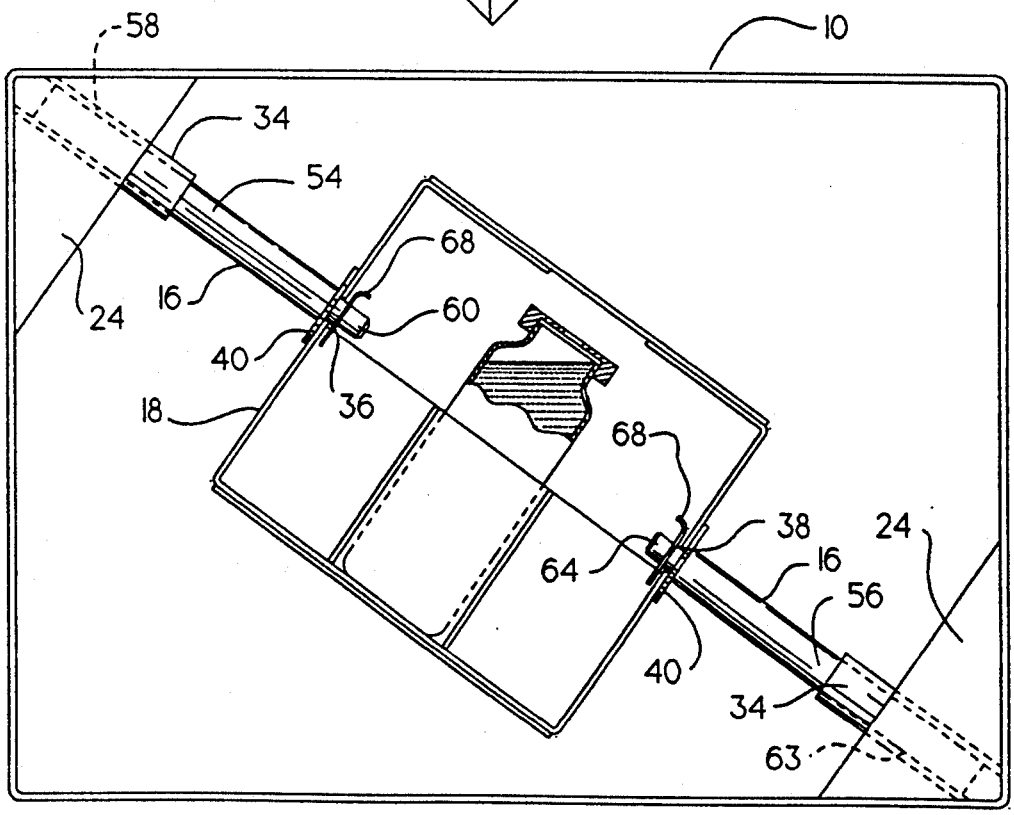
FIG. 10 is a sectional view of the shipping apparatus showing the alternative view of a shaft.
Figure 11:
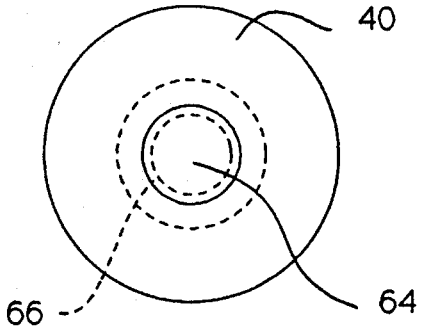
FIG. 11 is a front view of the end of the shaft of FIG. 10.

An alternative embodiment of the present invention is shown in FIG. 10. In this embodiment, shaft 16 has two portions 54 and 56. Portion 54 has a first end 58 and a second end 60. Portion 56 has a first end 62 and a second end 64. First end 58 is connected to corner 12 of outer container 10 by insertion into rod 34 of shaft support 24 as previously described. First end 62 is similarly connected to corner 14 of outer container 10.

Figure 12:
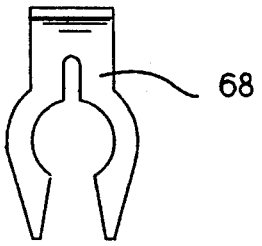
FIG. 12 is a top view of a spring clip used to support the shaft of FIG. 10.
Figure 13:
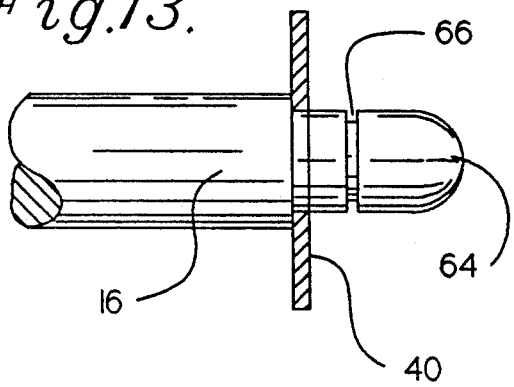
FIG. 13 is a top view of the shaft end of FIG. 11.

Second ends 60 and 64 of shaft portions 54 and 56 are rotatably connected to inner container 18 as described hereinbelow. Ends 60 and 64 each are provided with a groove 66 as shown in FIG. 13. End 60 of shaft portion 54 is inserted through aperture 36 of inner container 18 while end 64 of shaft portion 56 is inserted through aperture 38 of inner container 18. Washers 40 are placed in fixed positions along shaft portions 54 and 56 adjacent apertures 36 and 38, in the manner described above. A spring clip 68, shown in FIG. 12, is placed over groove 66 on shaft end 60 and similarly on shaft end 64 to rotatably connect each shaft portion 54 and 56 to inner container 18.

Figure 16:
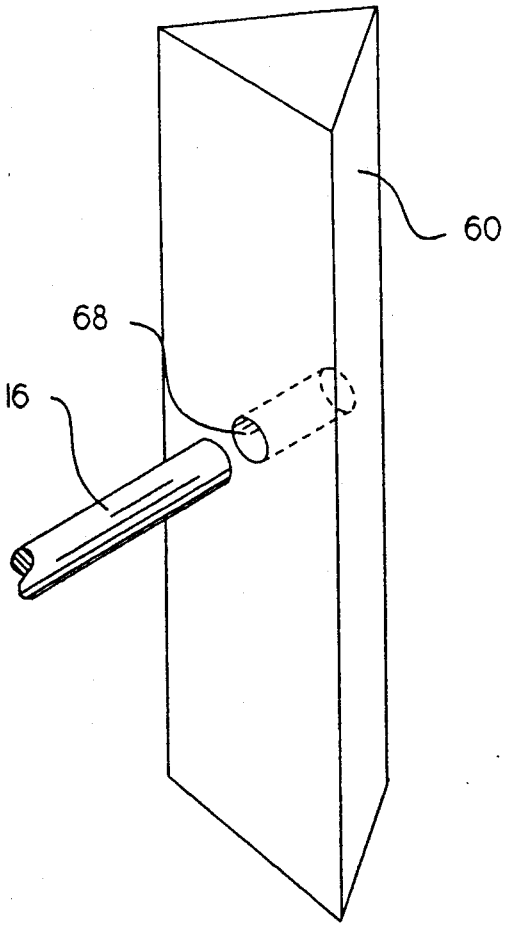
FIG. 16 is an exploded assembly view of the shaft support member and the shaft of the shipping apparatus of FIG. 14.
Figure 17:
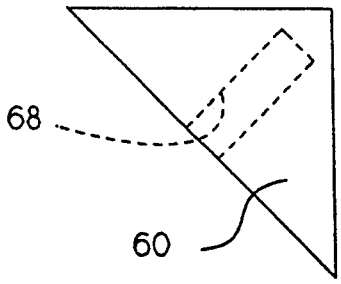
FIG. 17 is a top view of the shaft support member of FIG. 16.
Figure 18:
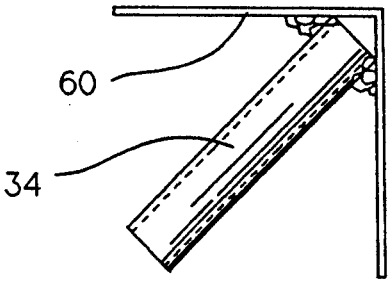
FIG. 18 is a top view of an alternate embodiment of the shaft support member of FIG. 16.
Figure 14:
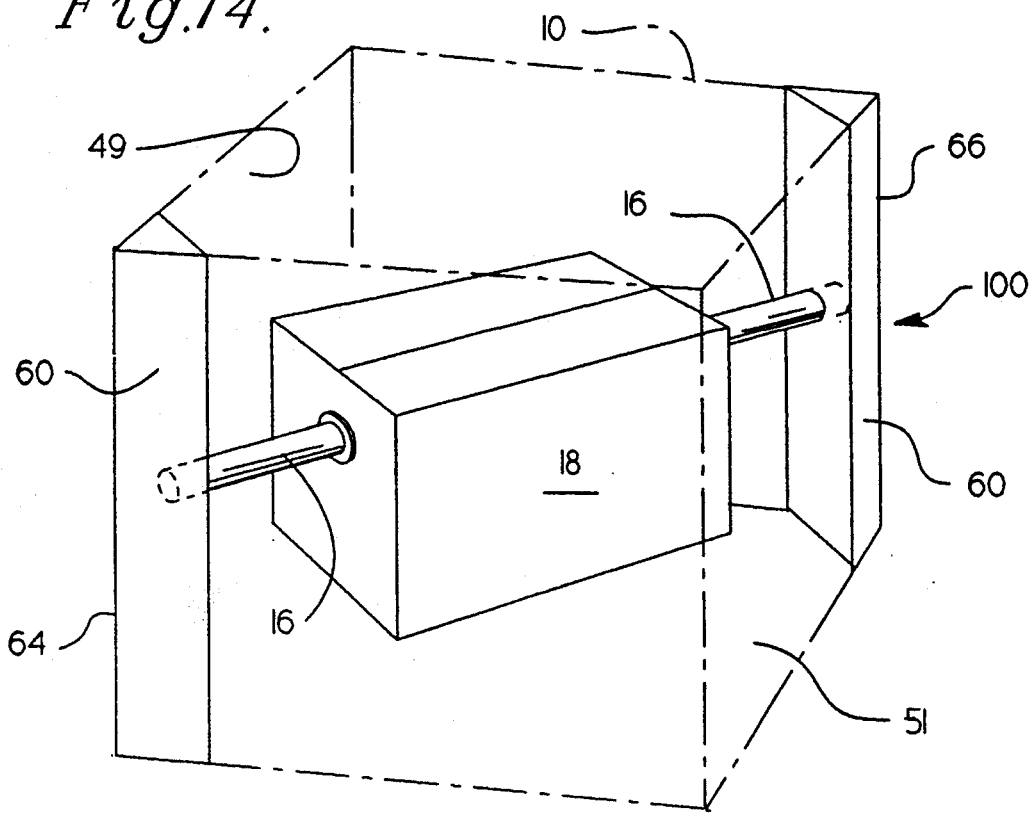
FIG. 14 is a perspective view of an alternate embodiment of the shipping apparatus of the present invention.
Figure 15:
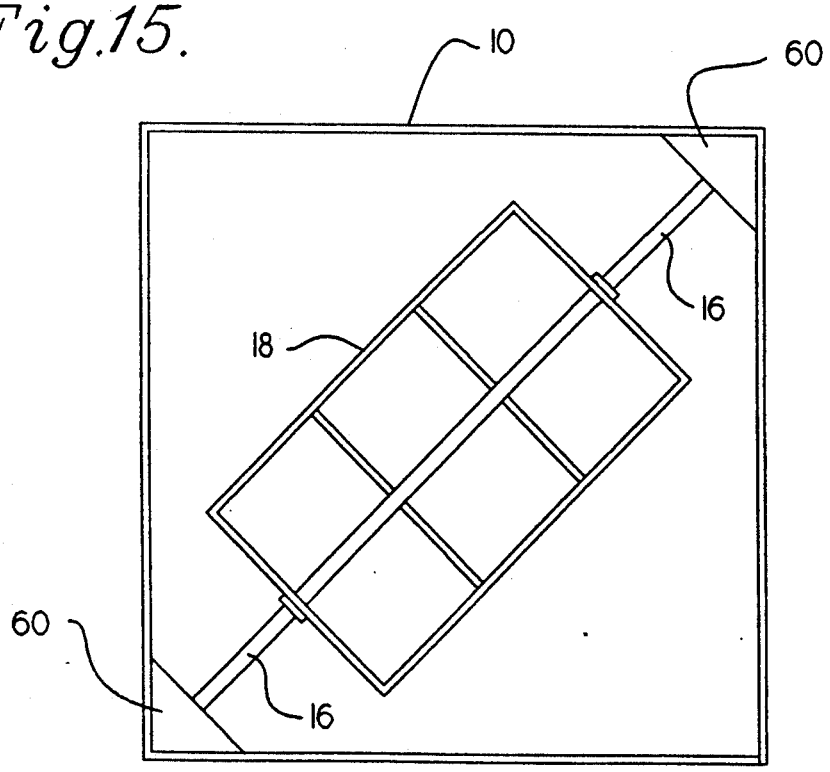
FIG. 15 is a top view of the shipping apparatus of FIG. 14.

In another embodiment of the present invention, as shown in FIGS. 14 and 15, shaft 16 is disposed along an axis that is substantially parallel to sides 49 and 51 of six sided outer container 10. In this embodiment, shaft support members 60 are mounted in opposing corners 64 and 66 of outer container 10. As further shown in FIGS. 16, 17 and 18, shaft support members 60 are adapted to fit into corners 49 and 51 of outer container 10 and are preferably constructed out of solid wood or aluminum. Each shaft support member 60 has an aperture 68 provided therein that is larger in diameter than shaft 16 to thereby enable shaft 16 to be slideably received therein. Apertures 68 are disposed within shaft support members in such a manner as to retain shaft 16 in an orientation that is substantially parallel to sides 49 and 51 of outer container 10. Inner container 18 is rotatably mounted to shaft 16 by using the various methods described hereinabove. In this embodiment, shaft support members may be constructed out of metal angle as shown in FIG. 18. Hollow cylindrical rod 34 is welded to angle 60 in an orientation that is substantially parallel to sides 49 and 51 of outer container 10. Shaft 16 is received in rod 34 as was discussed hereinabove.

Figure 19:
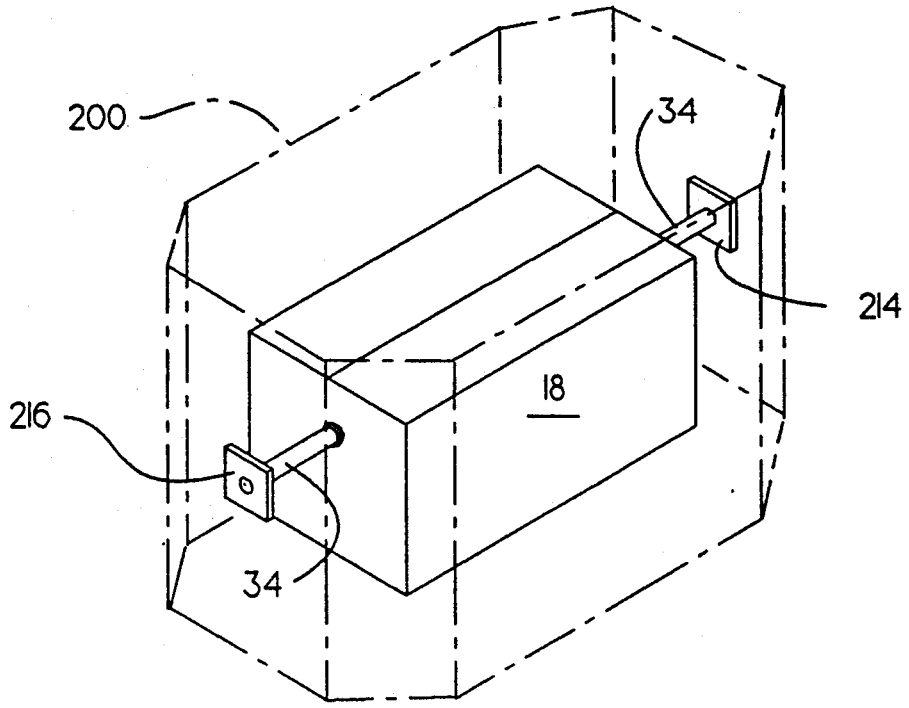
FIG. 19 is a perspective view of an alternate embodiment of the shipping apparatus of the present invention.
Figure 20:
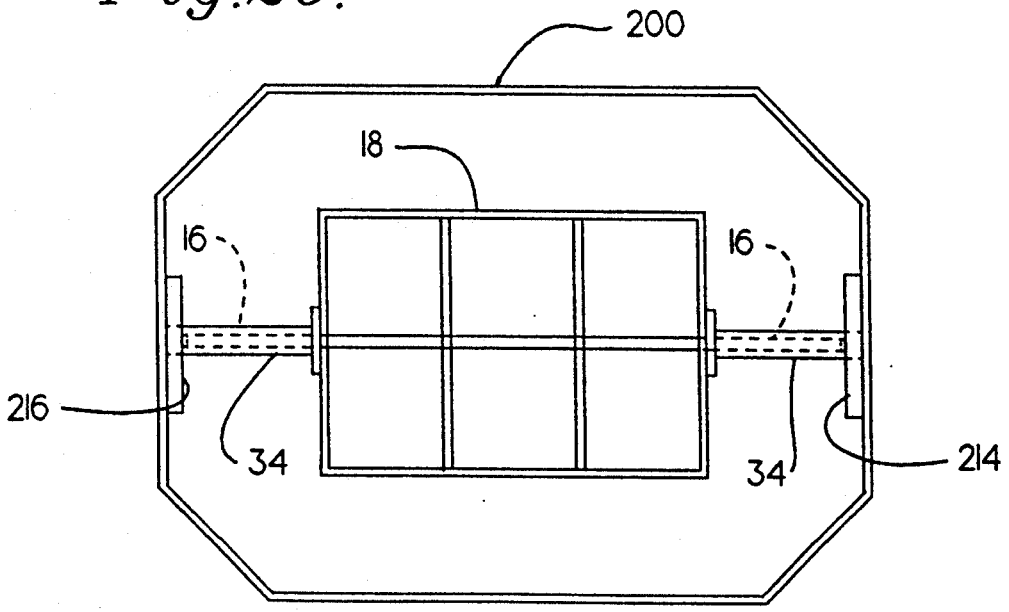
FIG. 20 is a top view of the shipping apparatus of FIG. 19.

In yet another embodiment of the present invention, as illustrated in FIGS. 19 and 20, outer container 200 is provided in the shape of a ten-sided decahedron. In this embodiment, shaft 16 is mounted along an axis that is substantially parallel to sides 210 and 212 of outer container 200. However, one of ordinary skill in the art will recognize that shaft member may be disposed at various orientations within outer container 200 provided that inner container 18 remains free to assume the desired angular orientation. Therefore, it will be understood that shaft support members 214 and 216 may be provided various shapes and configurations.

Figure 21:
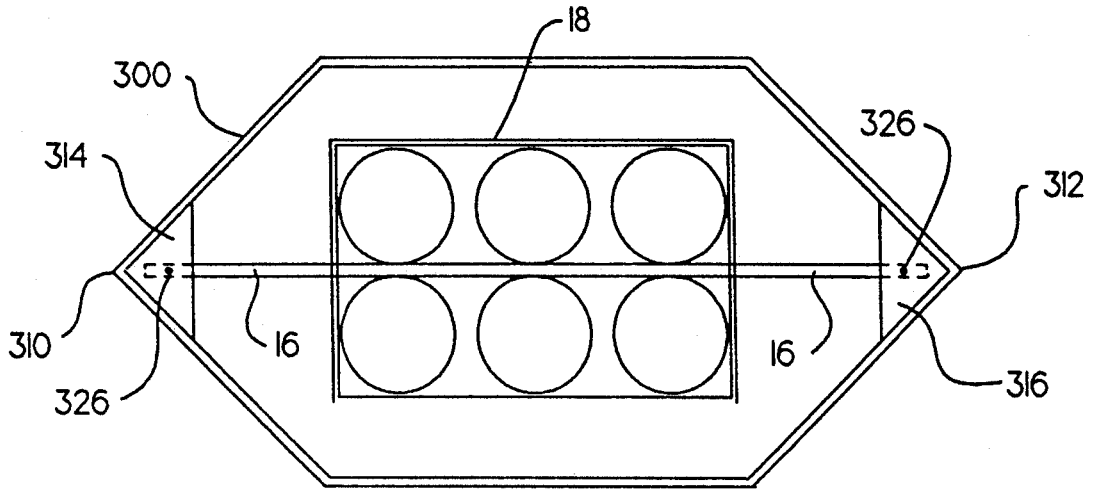
FIG. 21 is a top view of an alternate embodiment of the shipping apparatus of the present invention.
Figure 22:
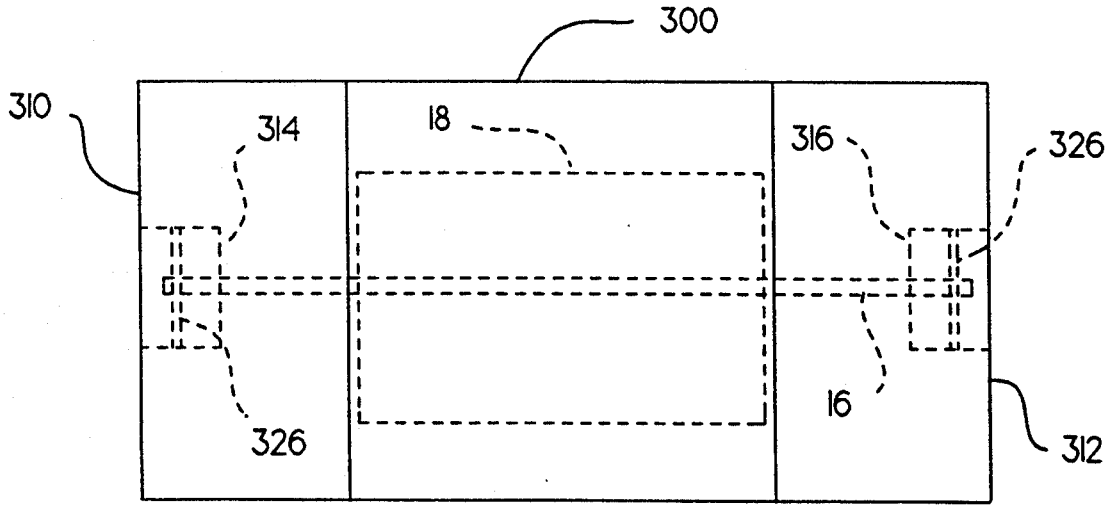
FIG. 22 is a side view of the shipping apparatus of FIG. 21.

In still another embodiment of the present invention, as shown in FIGS. 21 and 22, outer container 300 is provided in the shape of an eight sided octahedron. Shaft 16 is fastened to shaft support members 314 and 316 along an axis that is substantially parallel with sides 318 and 320 of outer container 300. Shaft support members 314 and 316 are adapted to be fastened into opposing corners 322 and 324 of outer container 300 and may be constructed out of wood, aluminum, or any other suitable material. Shaft support members 314 and 316 may be fastened to outer container 300 by any known fastening means that is compatible with outer container 300 such as, for example, gluing, stapling, or welding. Shaft support members 314 and 316 are positioned within corners 310 and 312 in such a manner as to provide inner container 18 with enough clearance so that it may freely rotate around shaft 16. It will be understood that shaft 16 may be fastened to support members 314 and 316 by any of the methods discussed hereinabove, or in the alternative may be fastened thereto by pins or screws 326.

Figure 23:
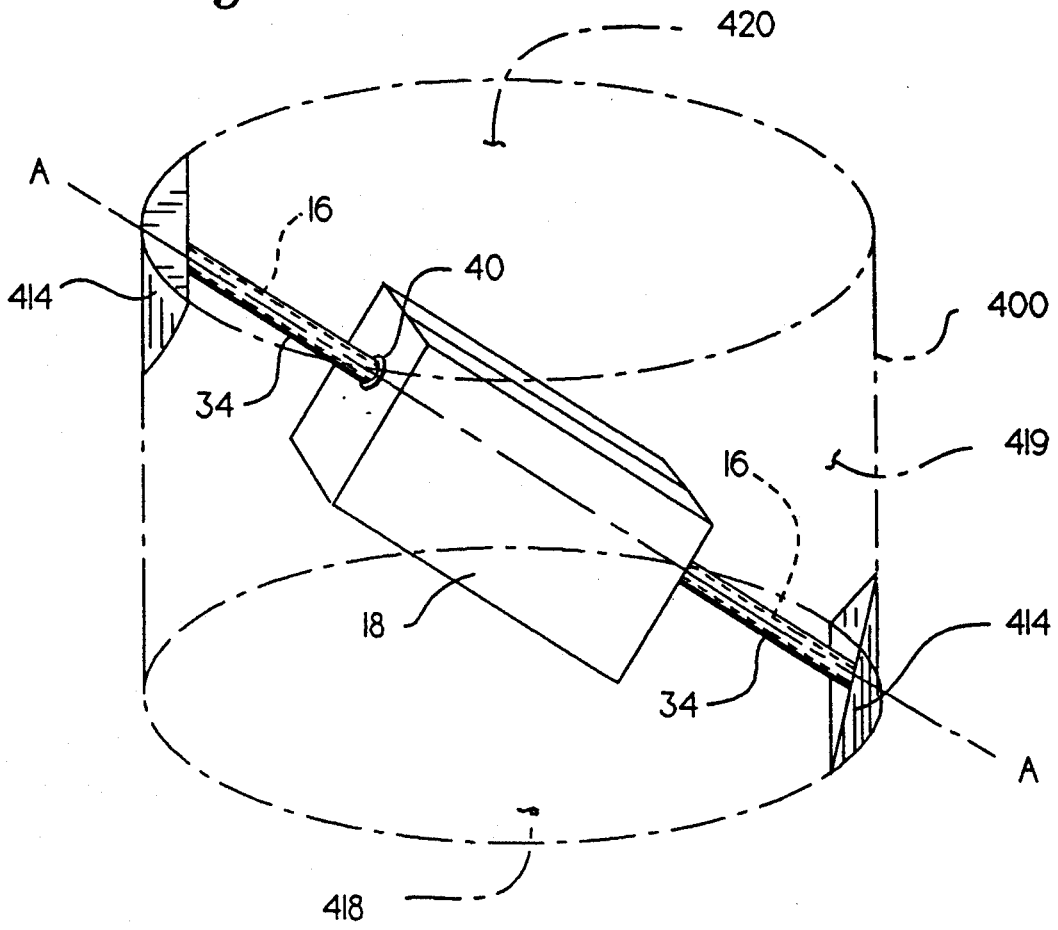
FIG. 23 is a perspective view of an alternate embodiment of the shipping apparatus of the present invention.
Figure 24:
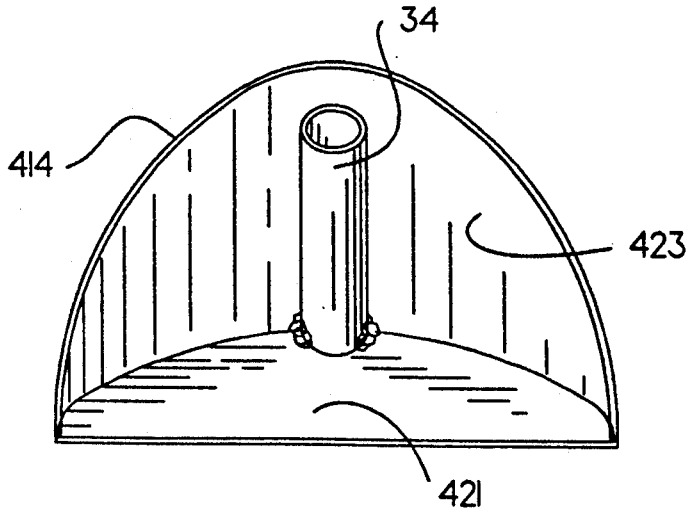
FIG. 24 is a front elevation view of the shaft support of FIG. 23.
Figure 25:
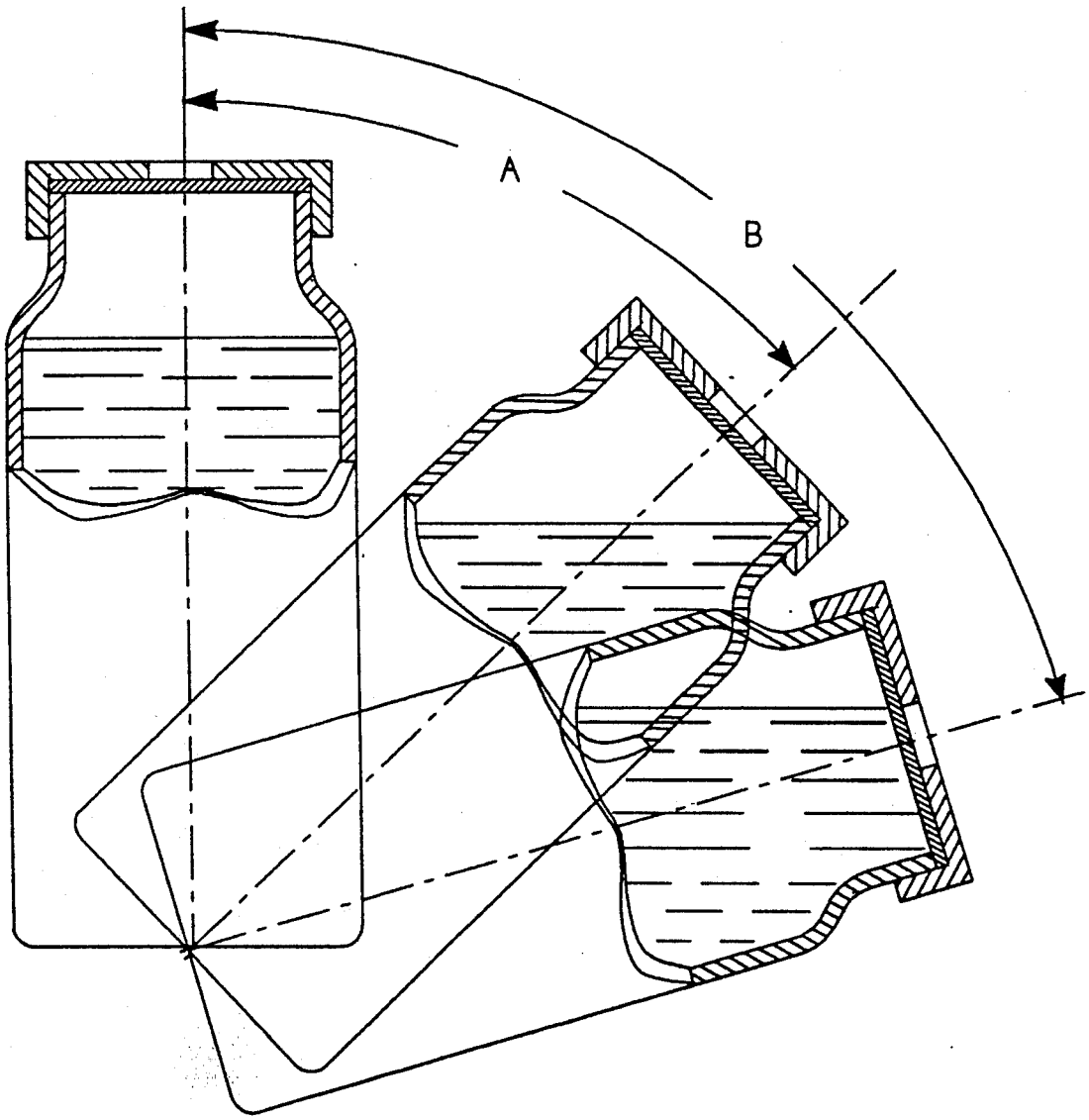
FIG. 25 is a front view of typical vented bottles depicted at various angular orientations.

In another embodiment of the present invention, as shown in FIG. 23, outer container 400 is provided in the shape of a cylinder having ends 418 and 420 affixed thereto. Inner container 18 is rotatably attached to shaft 16 which extends along axis A—A through cylinder 400. Shaft 16 may be mounted within outer container by shaft support members 414. As shown in FIG. 24, shaft support members 414 consist of a semi-circular bottom member 421 and corresponding side member 423 and are adapted to be received within cylinder 400 where ends 418 and 420 intersect cylinder side wall 419. Hollow cylindrical rod 34 is rigidly affixed to support member 414 where bottom member 421 and side member 423 intersect. It will be recognized that shaft support members 414 and 418 may be attached to ends 418 and 420 of container 400 by any suitable fastening means such as, for example, by stapling, welding or gluing. As in all of the other embodiments, outer container 400 is large enough so that inner container 18 may freely rotate around shaft 16 in order to assume the desired angular orientation. To practice this embodiment of the present invention, however, it will be understood that container 400 must be vertically positioned on end 418 or end 420 to prevent container 400 from rolling on side wall 419.

As illustrated in the foregoing Figures, the device of the present invention may easily be adapted to ship vented bottles of, for example, chemical solutions. It is important, however, that such bottles be maintained in a desired orientation to prevent the vents from being submerged and thus resulting in the spillage of the contents. As shown in FIG. 14, a typical vented bottle will have sufficient air space near its top or neck area to remain vented when it is oriented at an angle not greater than A, where A is approximately 45° from vertical. Angles somewhat greater than 45° will also be suitable. However, when the bottle is tilted at angle B, an angle closer to 90°, the bottle will no longer be vented and the contents would be free to exit the bottle. Shipping containers which are not cubic will result in different desirable angulations, but typically only a few degrees more or less than 45°. Different bottle configurations will also call for different desired angulations.

As depicted above, the present invention offers many advantages in the shipment of goods. In particular, the preferred embodiment of the present invention is simple and durable in that the only moving part is located inside the container itself. Furthermore, the present invention is very compact due to the absence of moving parts between the inner and outer containers for which additional clearance would be needed. Finally, due to its relatively simple design, the present invention is rather inexpensive to produce, almost to the point of being disposable.

While the present invention has been described in connection with preferred embodiments, it will be understood that modifications and variations apparent to those of ordinary skill in the art are within the scope of the present invention.

What is claimed is:

1. A shipping apparatus comprising:

a closable rectilinear outer container having a major axis extending along a diagonal span;

a closable inner container disposed in and spaced from said outer container and mounted for rotation about said major axis such that said inner container is freely rotatable within said outer container;

means for mounting said inner container about said major axis; and means for causing said inner container to assume a predetermined orientation regardless of the orientation of said outer container about said major axis with respect to gravitational forces.

2. A shipping apparatus as recited in claim 1 wherein said mounting means is a shaft.

3. A shipping apparatus as recited in claim 2 wherein said outer container has a first surface and a second surface generally opposing said first surface, and said shaft is a continuous member having a first end connected to said first surface of said outer container and a second end connected to said second surface of said outer container.

4. A shipping apparatus as recited in claim 2 wherein said outer container has a first surface and a second surface generally opposing said first surface and said shaft has two portions, each of said portions having a first end and a second end, wherein one of said first ends is connected to said first surface of said outer container and the other of said first ends is connected to said second surface of said outer container, and said second ends are each rotatably connected to said inner container.

5. A shipping apparatus as recited in claim 1 wherein said means for causing said inner container to assume said predetermined orientation is a weight disposed in said inner container.

6. A shipping apparatus as recited in claim 1 wherein said outer container is in the shape of a decahedron.

7. A shipping apparatus as recited in claim 6 wherein said mounting means is a shaft.

8. A shipping apparatus as recited in claim 1 wherein said outer container is in the shape of an octahedron.

9. A shipping apparatus as recited in claim 8 wherein said mounting means is a shaft.

10. A shipping apparatus comprising:

a closable approximately cubical outer container having an axis extending substantially diagonally therethrough;

a closable inner container disposed in and spaced from said outer container and mounted for rotation about said axis such that said inner container is freely rotatable within said outer container;

means for mounting said inner container about said axis; and means for causing said inner container to assume a predetermined orientation about said axis regardless of the orientation of said outer container.

11. A shipping apparatus as recited in claim 10 wherein said mounting means is a shaft.

12. A shipping apparatus as recited in claim 11 wherein said outer container has a first corner at one end of said axis and a second corner generally opposing said first corner, and said shaft is a continuous member having a first end connected to said first corner of said outer container and a second end connected to said second corner of said outer container.

13. A shipping apparatus as recited in claim 11 wherein said outer container has a first corner at one end of said axis and a second corner generally opposing said first corner and said shaft has two portions, each of said portions having a first end and a second end, wherein one of said first ends is connected to said first corner of said outer container and the other of said first ends is connected to said second corner of said outer container, and said second ends are each rotatably connected to said inner container.

14. A shipping apparatus as recited in claim 10 wherein said means for causing said inner container to assume said predetermined orientation is a weight disposed in said inner container.

* * * * *